US010027081B2

(12) United States Patent
Sviben

(10) Patent No.: US 10,027,081 B2
(45) Date of Patent: Jul. 17, 2018

(54) METHOD OF STRANDED ELECTRICAL WIRE CONNECTION

(71) Applicant: Jeremy Sviben, Medford Lakes, NJ (US)

(72) Inventor: Jeremy Sviben, Medford Lakes, NJ (US)

( * ) Notice: Subject to any disclaimer, the term of this patent is extended or adjusted under 35 U.S.C. 154(b) by 294 days.

(21) Appl. No.: 15/097,353

(22) Filed: Apr. 13, 2016

(65) Prior Publication Data

US 2016/0308321 A1 Oct. 20, 2016

Related U.S. Application Data

(60) Provisional application No. 62/147,353, filed on Apr. 14, 2015.

(51) Int. Cl.
*H01R 43/05* (2006.01)
*H01R 43/00* (2006.01)
*H01R 43/042* (2006.01)

(52) U.S. Cl.
CPC ..... *H01R 43/05* (2013.01); *H01R 43/005* (2013.01); *H01R 43/042* (2013.01)

(58) Field of Classification Search
CPC .... G02B 6/255; G02B 6/2551; G02B 6/3817; G02B 6/3825; G02B 6/3857; H01R 43/005; H01R 43/042; H01R 43/05
See application file for complete search history.

(56) References Cited

U.S. PATENT DOCUMENTS 8,985,864 B2 * 3/2015 Ott ..... G02B 6/3825 385/70
2013/0156379 A1 * 6/2013 Ott ..... G02B 6/36 385/76
2013/0183001 A1 * 7/2013 Ott ..... G02B 6/3825 385/72
2013/0216186 A1 * 8/2013 Ott ..... G02B 6/3825 385/70

* cited by examiner

*Primary Examiner* — Carl Arbes
(74) *Attorney, Agent, or Firm* — Stuart M. Goldstein

(57) ABSTRACT

A method of stranded electrical wire connection involves stripping the insulation of the ends of stranded wire and inserting a compression member over the ends of the wire, and applying constant, irreversible ratcheting pressure to the compression member to compress the compression member over each end of the stranded wires. The compressed stranded wires and compression member are then inserted into a tube connector which is filled with a dielectric gel. The tube connector has a cover with a snap connector member. When the compressed wire connection is fully encased within the connector tube, the cover is closed over the top of the connector tube and snapped and locked shut, to ensure for a waterproof electrical connection.

6 Claims, 6 Drawing Sheets

METHOD OF STRANDED ELECTRICAL WIRE CONNECTION

RELATED APPLICATION

This application claims the benefit of provisional application Ser. No. 62/147,353, filed on Apr. 14, 2015.

BACKGROUND OF THE INVENTION

A variety of methods are currently employed for attaching lengths of stranded electrical wire. Most of these methods require that a portion of the insulation covering the end of the wire be stripped to expose the conductor strands of the wire. The exposed strands are then twisted, compressed, or otherwise manually secured together by means of a crimping tool, pliers, or even by hand. However, these methods, fundamentally, will not produce a secure, waterproof, stranded wire to stranded wire connection which will withstand stress forces which the wire connection experiences during use. Such wire connections are not secure and will eventually fail as a result of the naturally occurring conditions to which the connections are exposed.

More specifically, wires connected in this manner, when energized and then de-energized will create a heating and cooling effect, as the flow of current runs through the wires and is then turned off. This constant energizing and de-energizing of the wires causes intermittent expansion and then contraction of the wires. The endless cycle of expansion and contraction causes a constantly deteriorating effect on the wires which literally will destroy them in a relatively short period of time.

SUMMARY OF THE INVENTION

U.S. Pat. No. 8,667,676 discloses a method of stranded electrical wire connection which drastically reduces and eliminates the damaging heating and cooling effect in the connections, due to normal operation to the wires, yet caused by inconsistent tightening and crimping techniques. The method employs a ratcheting crimping tool which applies a designated, constant ratcheting compression to permanently connect stranded 8-18 gauge wires from lighting fixtures, including LED lamps, florescent lamps, and feed/power sources, by eliminating the spaces between the wire strands and thus eliminating the possibility of expansion and contraction between the strands during use. Application of the method eliminates the inconsistent and loose connections which result in ultimate untimely failure of electrical connections. The method is designed for use with stranded wire only, in low voltage, i.e. 30 volts or less, applications.

The method of the stranded electrical wire connection of the referenced '676 patent involves stripping the insulation off the ends of stranded wire, inserting a metallic barrel member over the ends of the wire, applying ratcheting pressure to the barrel member to compress the barrel member over each end of the stranded wires, and then applying constant, irreversible ratcheting pressure to the wire containing barrel to substantially eliminate the spaces between the strands and to form a permanent barrel to wire connection between the lengths of wire. A shrink tube with an inner layer of adhesive is positioned over the permanent connection and the shrink tube, with its layer of adhesive, is heated, thus substantially eliminating any space between the shrink tube and the permanent connection. Utilizing this method results in a permanent, waterproof connection between the stranded wire which eliminates all expansion and contraction within the permanent connection during use.

The method of the current invention utilizes the same crimping tool concept of the '676 patent, but instead of heat shrink sealing the wire connection to make it waterproof, the wire crimped connection is inserted into a dielectric gel filled connector tube having a cover with a snap connector member. Once the crimped wire connection is fully inserted with the connector tube, the cover is snapped shut over the tube connector to maintain the waterproof connection.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
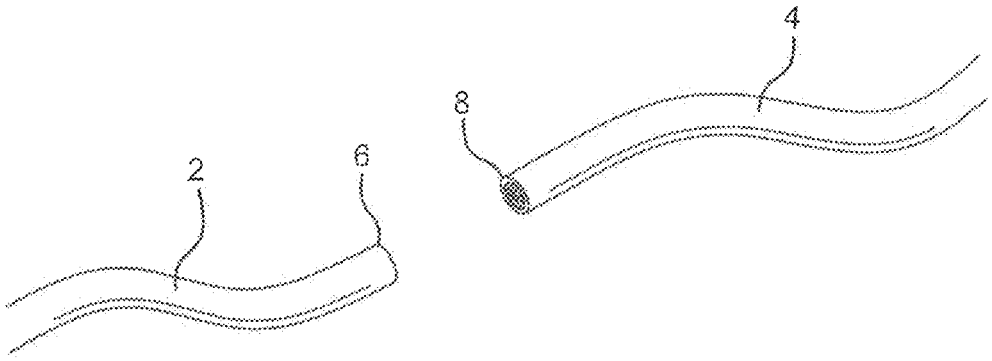
FIG. 1 shows the two lengths of stranded electrical wire to be connected in accordance with the method of the present invention.
Figure 2:
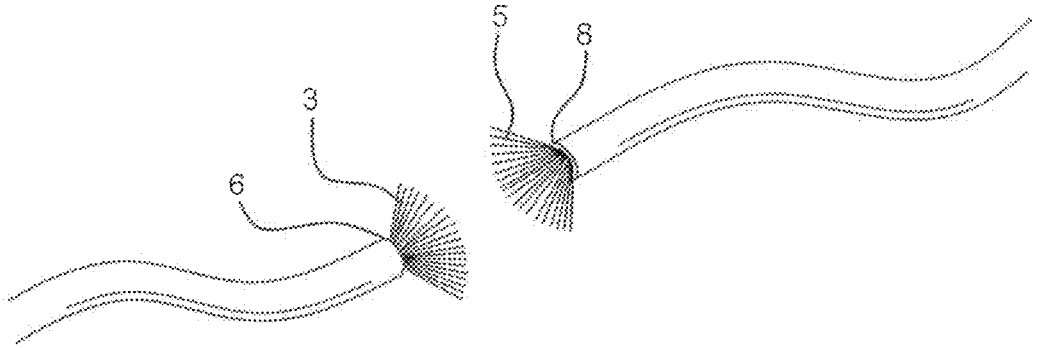
FIG. 2 shows the first step of the method of the present invention, in which insulation has been removed.

The object of the invention is to permanently connect lengths of stranded electrical wire in order to eliminate the possibility of expansion and contraction between the strands of the wire and thus ensure for the longevity and waterproofing of the connection. As seen in FIG. 1, insulated covered electrical stranded wires 2 and 4 with conductor strands 3 and 5, are provided for connection. Insulation is stripped off ends 6 and 8 of wires 2 and 4 to expose strands 3 and 5, as seen in FIG.

Figure 3:
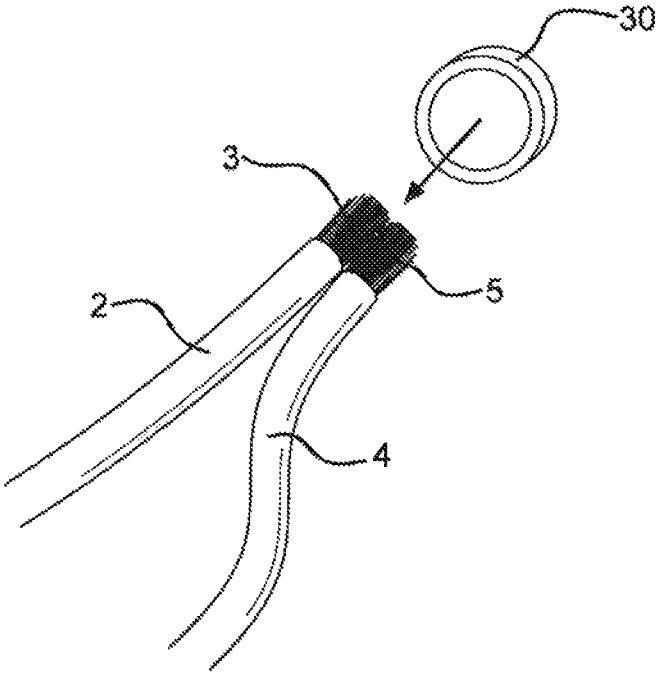
FIG. 3 shows the wire strands meshed together, to be joined in the step of the method of the present invention which utilizes a dielectric gel filled tube.
Figure 4:
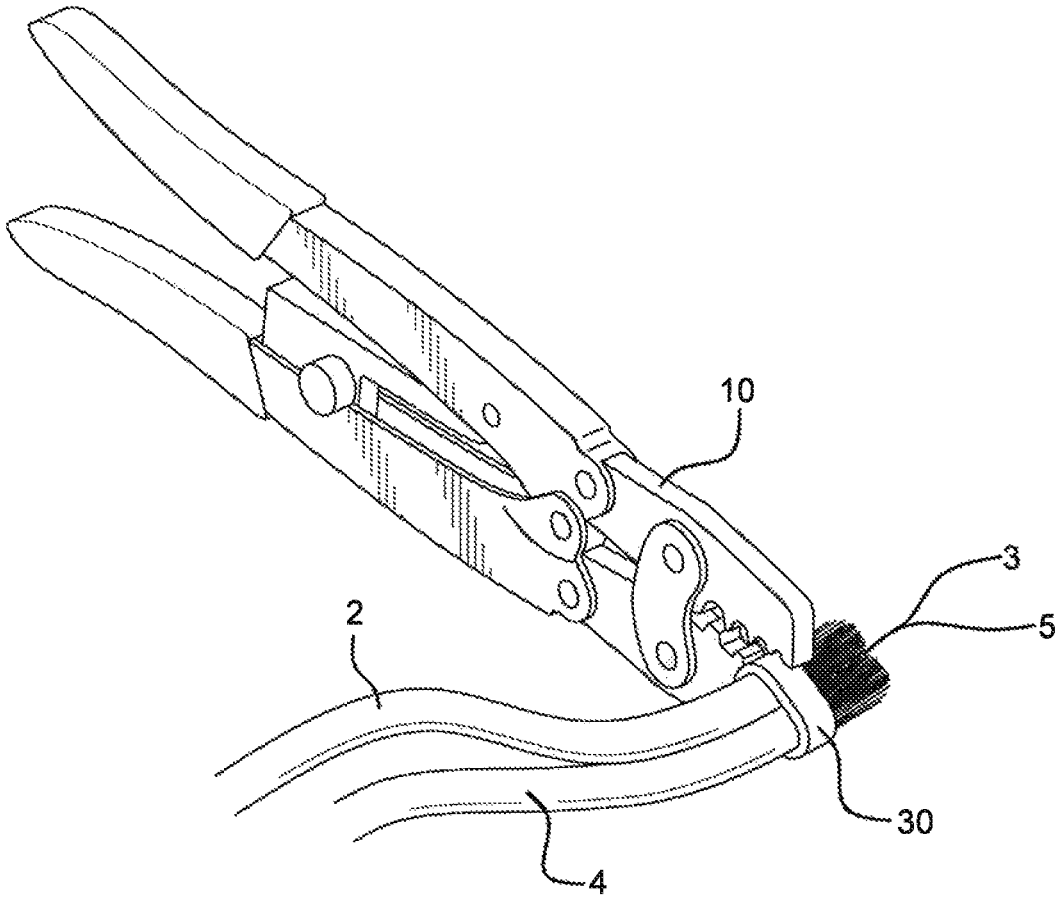
FIG. 4 shows the wire crimping step of the method.

The wires are then positioned together, with their respective strands 3 and 5 pressed together and intermeshed, as seen in FIG. 3. A metallic compression member, such as halo ring 30, is positioned around wires 2 and 4 and ratcheting crimper tool 10 is utilized to provide constant, irreversible ratcheting pressure to the halo ring, to tightly compress strands 3 and 5 together. As has previously been discussed, ratcheting pressure, accomplished in distinct, irreversible ratcheting intervals, will tightly compress the strands of the wire such that the spaces between the strands and the barrel member are substantially eliminated. A special ratcheting crimper tool is used, since once the crimping process begins, this tool provides a constant pressure which will not reverse until the connection has been fully compressed or the tool's release button is pushed. This creates a consistent, increasingly tight, compressed wire connection regardless of the strength of the installer.

Figure 5:
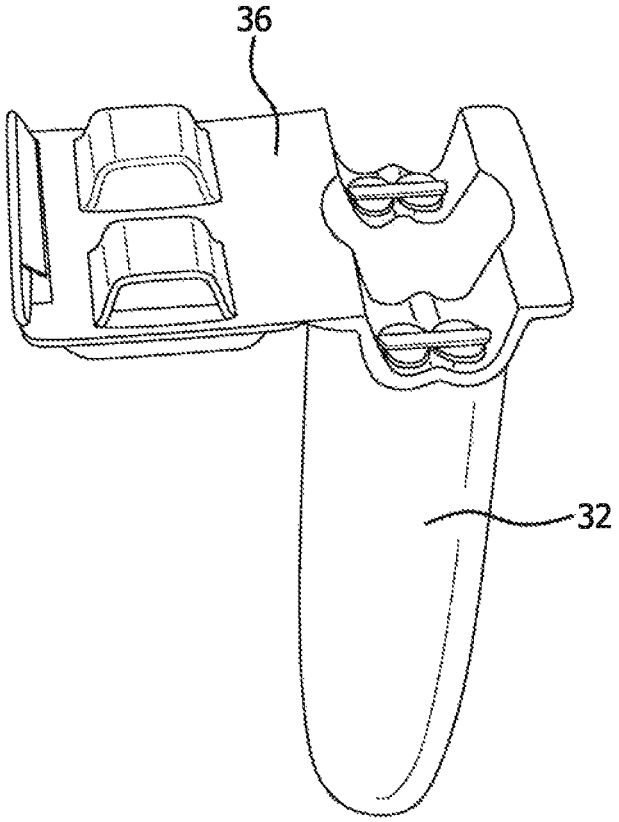
FIG. 5 shows the gel filled tube, with its cover opened, into which the crimped wire connection is to be inserted.
Figure 6:
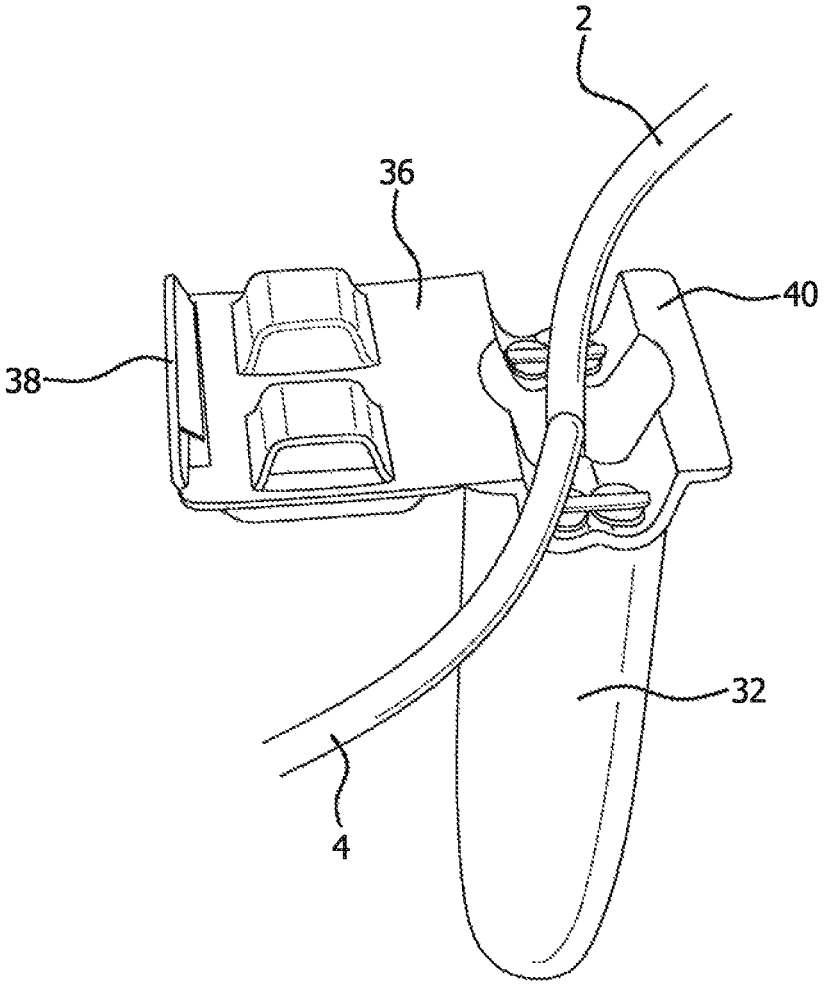
FIG. 6 shows the gel filled tube, with its cover open, with crimped wires extending out of the tube.
Figure 7:
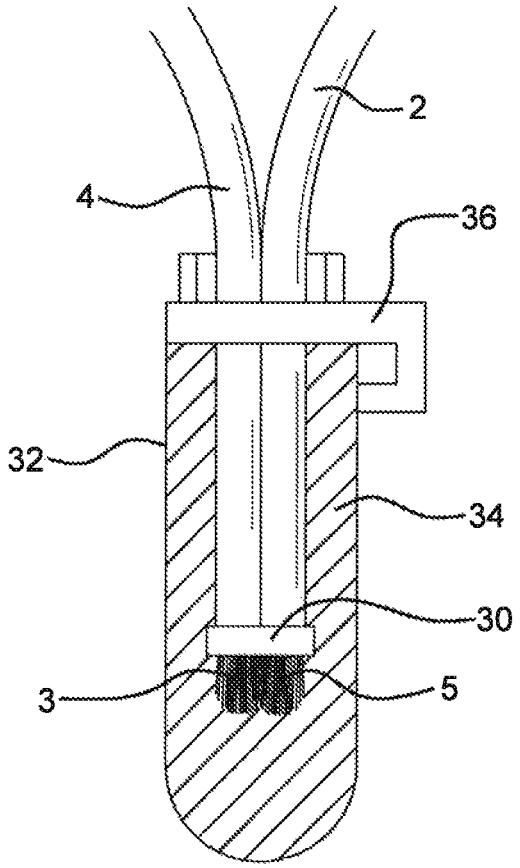
FIG. 7 shows the crimped wire connection sealed, in waterproof fashion, within the tube.

After halo ring 30 has sufficiently compressed and crimped strands 3 and 5, this wire connection is inserted into tube connector 32 filled with dielectric gel 34. See FIGS. 5 and 6. Tube connector cover 36 with snap connector member 38, is then rotated over tube connector 32. Snap connector member 38 is then snapped over and locked onto lip 40 of tube connector 32. This seals and provides a watertight connection between wires 2 and 4 within tube connector 32, as seen in FIG. 7.

It is contemplated that the method of the present invention can be used to connect 8-20 gauge stranded electrical wires which come from lighting fixtures, LED lamps, florescent lamps, and other feed power sources. However, wire of different gauges can successfully be used with this method. The type and size of the wires described herein should not be considered restrictive to the method of the invention. The herein method is directed for use with stranded wire only, for low voltage, i.e. 600 volts or less, applications.

Application of this method will result in electrical connections which can be buried in soil types ranging from acid to alkali. The connections which are made are especially important for use in the connection of current/voltage sensitive lighting sources such as LED lamps and low voltage lighting fixtures.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. The method of insulated stranded electrical wire connection comprising the steps of:

providing separate lengths of stranded electrical wire to be connected;

stripping insulation off the ends of each of said lengths of wire to expose conductor strands;

pressing the exposed strands together so that the strands are intermeshed;

providing a compression member;

inserting the compression member over the pressed, intermeshed strands;

applying constant pressure to the compression member in distinct, irreversible, ratcheting pressure intervals to tightly compress the exposed conductor strands of each length of wire within compression member;

continuing to apply constant pressure to the compression member in distinct, irreversible, ratcheting pressure intervals until all spaces between the strands and the compression member are eliminated, forming a secure connection between said lengths of wire with no spaces between the conductor strands and the compression member;

providing a tube connector containing a dielectric gel, the tube connector comprising a tube cover having a snap connector member;

inserting the pressed, intermeshed strands and compression member into the tube connector and dielectric gel;

enveloping the strands and the member within the dielectric gel;

rotating the tube cover over the tube connector; and locking the snap connector member over the tube cover, thereby providing a watertight connection between the wires within the tube connector.

2. The method as in claim 1 further comprising the step of providing a ratcheting crimping tool to apply the constant pressure.

3. The method as in claim 2 comprising the further step of applying the constant pressure in distinct ratcheting intervals by use of the crimping tool.

4. The method as in claim 1 wherein in applying constant pressure the compression member and exposed conductor strands are subjected to increasingly tightened, irreversible compression.

5. The method as in claim 4 comprising the further step of providing a ratcheting crimper to apply the increasingly tightened, irreversible compression.

6. The method as in claim 1 wherein the compression member comprises a halo ring.

* * * * *